US006008766A

United States Patent [19]

Maeda et al.

[11] Patent Number: 6,008,766

[45] Date of Patent: Dec. 28, 1999

[54] REAR WINDOW GLASS ANTENNA FOR AUTOMOBILES

[75] Inventors: Masaru Maeda, Hyogo; Hiroshi Iijima, Hiroshima, both of Japan

[73] Assignee: Nippon Sheet Glass Co., Ltd., Osaka, Japan

[21] Appl. No.: 08/632,763

[22] Filed: Apr. 15, 1996

Related U.S. Application Data

[63] Continuation of application No. 08/159,059, Nov. 29, 1993, abandoned.

[30] Foreign Application Priority Data

Nov. 27, 1992 [JP] Japan ..... 4-341176

[51] Int. Cl.[6] ..... H01Q 1/32

[52] U.S. Cl. ..... 343/713; 343/704

[58] Field of Search ..... 343/713, 704, 343/711, 712; H01Q 1/32

[56] References Cited

U.S. PATENT DOCUMENTS

| | | | |
|---|---|---|---|
| 3,728,732 | 4/1973 | Igarashi | 343/713 |
| 4,721,964 | 1/1988 | Sato et al. . | |
| 4,757,322 | 7/1988 | Yokogawa et al. . | |
| 4,914,447 | 4/1990 | Ichii et al. | 343/713 |
| 5,185,612 | 2/1993 | Tsukada et al. | 343/713 |
| 5,220,336 | 6/1993 | Hirotsu et al. . | |
| 5,229,780 | 7/1993 | Hirotsu et al. | 343/713 |
| 5,231,410 | 7/1993 | Murakami et al. | 343/713 |
| 5,239,303 | 8/1993 | Hirotsu et al. | 343/713 |
| 5,255,002 | 10/1993 | Day . | |
| 5,264,858 | 11/1993 | Shiina . | |
| 5,365,242 | 11/1994 | Shiina | 343/713 |

FOREIGN PATENT DOCUMENTS

| | | | |
|---|---|---|---|
| 0 559 196 | 9/1993 | European Pat. Off. . | |
| 57-188103 | 11/1982 | Japan | 343/713 |
| 3-265202 | 11/1991 | Japan . | |
| 2 131 622 | 6/1984 | United Kingdom . | |
| WO88/09569 | 12/1988 | WIPO . | |

*Primary Examiner*—Hoanganh Le
*Attorney, Agent, or Firm*—Merchant & Gould P.C.

[57] ABSTRACT

A rear window glass antenna on a rear window glass panel of an automobile includes a plurality of heating electric wires disposed horizontally on the rear window glass panel, a feeder terminal disposed on the rear window glass panel near an edge thereof, and a plurality of antenna wires disposed on the rear window glass panel. The antenna include a first section extending from the feeder terminal along an edge of the rear window glass panel, a second section folded from an end of the first section toward a vertical central line of the rear window glass panel, and a third section extending as a main antenna section from an end of the second section. The second section includes a horizontally folded portion which comprises a plurality of thin wires lying parallel to each other.

3 Claims, 5 Drawing Sheets

FIG. 5

UNIT: DIPOLE RATIO(dB)

| FREQUENCY | NUMBER OF FOLDED WIRES | | |
|---|---|---|---|
| (MHz) | 1 | 2 | 3 |
| 76 | −14 | −12.5 | −12.7 |
| 77 | −13.6 | −12.5 | −12.5 |
| 78 | −13.4 | −12.3 | −12 |
| 79 | −13.3 | −12.1 | −12 |
| 80 | −14 | −12.4 | −12.2 |
| 81 | −14.9 | −12.6 | −12.3 |
| 82 | −14.5 | −12.4 | −12 |
| 83 | −14.3 | −13.4 | −12.2 |
| 84 | −14 | −13.9 | −12.4 |
| 85 | −13.8 | −13.1 | −12.3 |
| 86 | −13.6 | −13 | −12.4 |
| 87 | −13.5 | −12.8 | −12.3 |
| 88 | −13.5 | −12.6 | −11.9 |
| 89 | −13.8 | −13 | −12 |
| 90 | −14 | −12.9 | −12.2 |
| Ave. | −13.9 | −12.8 | −12.2 |

REAR WINDOW GLASS ANTENNA FOR AUTOMOBILES

This is a Continuation of application Ser. No. 08/159,059, filed Nov. 29, 1993, now abandoned.

BACKGROUND OF THE INVENTION

1. Field of the Invention

The present invention relates to a rear window glass antenna for use on an automobile for receiving radio or television broadcast signals.

2. Description of the Prior Art

It is customary for automobiles to have an antenna on a rear window glass panel for receiving radio or television broadcast signals in combination with a plurality of defrosting electric wires. The rear window glass antenna has antenna wires including a folded portion to achieve phase adjustment with respect to certain frequency bands for an increased reception gain.

Any portions of the antenna wires which are exposed cut of a masked area on the rear window glass would pose a problem on the appearance of the rear window glass. Therefore, the width of the folded portion of the antenna wires which is exposed out of the masked region should not be too large, and is usually held to 1 mm.

The antenna wires in the masked area where they are concealed by a flange of the automobile body have a width ranging from 3 to 5 mm.

Since the folded portion of the antenna wires has a high impedance, its sensitivity is very low because of the small width of about 1 mm.

One known rear window glass antenna is disclosed in Japanese patent publication No. 61-5282 published Feb. 17, 1986.

SUMMARY OF THE INVENTION

It is therefore an object of the present invention to provide a rear window glass antenna for automobiles which has a relatively high sensitivity that is achieved without increasing the width of antenna wires exposed out of a masked area on a rear window glass panel.

According to the present invention, there is provided a rear window glass antenna on a rear window glass panel of an automobile, comprising a plurality of heating electric wires disposed horizontally on the rear window glass panel, a feeder terminal disposed on the rear window glass panel near an edge thereof, and a plurality of antenna wires disposed on the rear window glass panel and including a first section extending from the feeder terminal along an edge of the rear window glass panel, a second section folded from an end of the first section toward a vertical central line of the rear window glass panel, and a third section extending as a main antenna section from an end of the second section, the second section comprising a plurality of thin wires lying rarallel to each other.

The second section may include a horizontally folded portion, the horizontally folded portion comprising the plurality of thin wires lying parallel to each other.

The number of thin wires of the second section may range from 2 to 4.

Each of the thin wires may be of a width ranging from 0.4 to 1.2 mm, and the distance between the central axes of the thin wires may range from 1 to 3 mm.

The above and further objects, details and advantages of the present invention will become apparent from the following detailed description of preferred embodiments thereof, when read in conjunction with the accompanying drawings.

BRIEF DESCRIPTION OF THE DRAWINGS

FIG. 5 is a table of some numerical values of the sensitivity vs. frequency characteristics shown in FIG. 4.

DETAILED DESCRIPTION OF THE PREFERRED EMBODIMENTS

Figure 1:
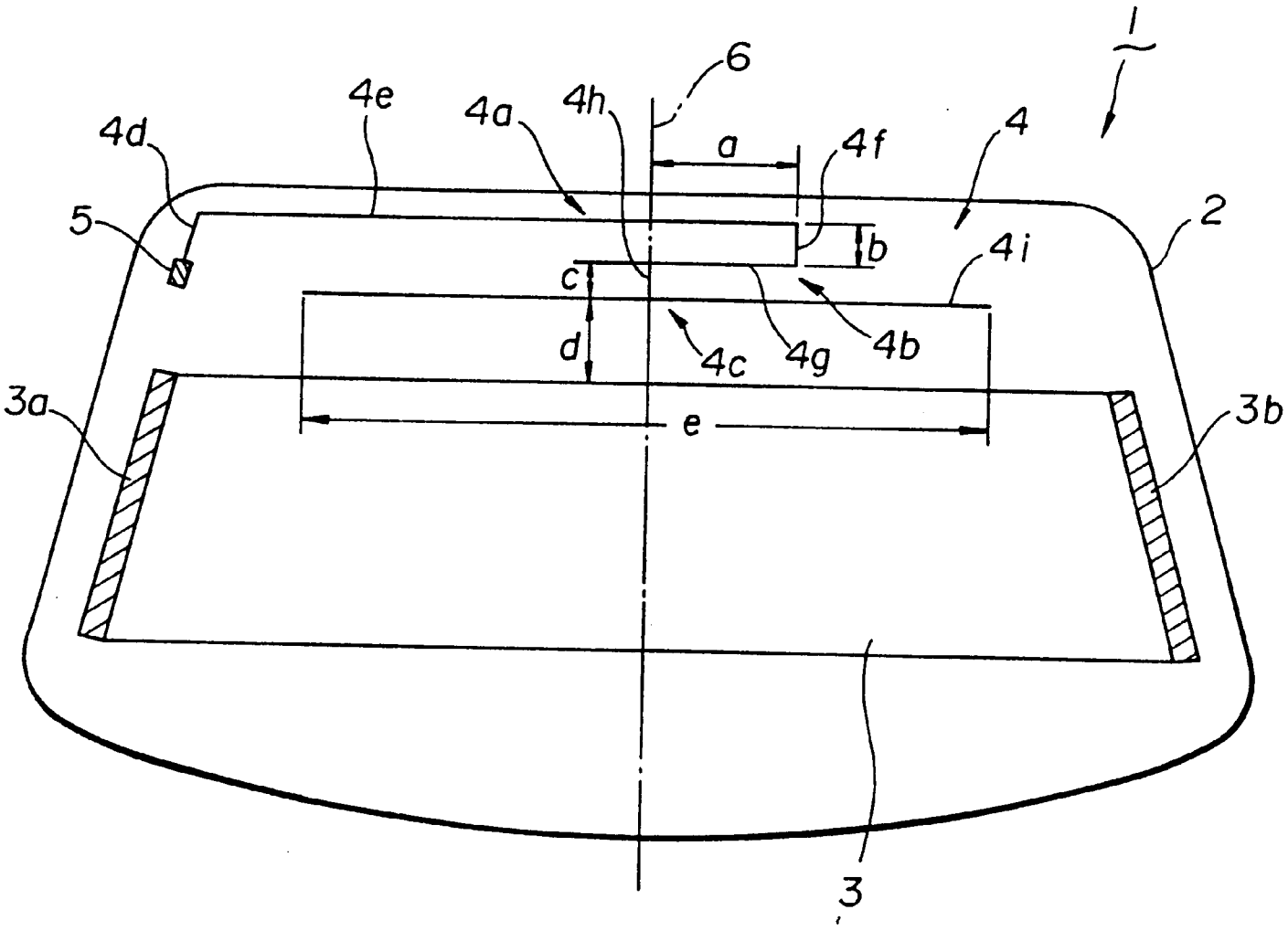
FIG. 1 is a plan view of a wire pattern of a rear window glass antenna on a rear window glass panel for an automobile according to the present invention.

As shown in FIG. 1, a rear window glass antenna 1 according to the present invention comprises a group 3 of heating electric wires disposed on and extending horizontally an an automobile rear window glass panel 2, a group 4 of antenna wires disposed on the rear window glass panel 2 above the group 3 of heating electric wires, and a feeder terminal 5 connected to the antenna wires at a vertical edge of the rear window glass panel 2 for transmitting a received ratio or television broadcast signal to a receiver (not shown).

The group 3 of heating electric wires is connected to a battery (not shown) through a pair of buses 3*a*, 3*b* on their opposite ends. When energized, the heating electric wires defrost the rear window glass panel 2.

The group 4 of antenna wires comprises three antenna sections including an L-shaped section 4*a*, an L-shaped section 4*b*, and a T-shaped section 4*c* which is a main antenna section.

The L-shaped section 4*a* comprises a vertical portion 4*d* extending upwardly from the feeder terminal 5 and a horizontal portion 4*e* bent from an upper end of the vertical portion 4*d* along an upper horizontal edge of the rear window glass panel 2 beyond a vertical central line 6 thereof.

The L-shaped section 4*b* comprises a vertical portion 4*f* extending downwardly from a distal end of the horizontal portion 4*e* of the L-shaped section 4*a*, and a horizontal portion 4*g* bent from a lower end of the vertical portion 4*f* up to the vertical central line 6.

The T-shaped section 4*c*, which is electromagneticilly coupled to the group 3 of heating electric wires at high frequencies, comprises a vertical portion 4*h* extending downwardly from a distal end of the horizontal folded portion 4*g* of the L-shaped section 4*b* along the vertical central line 6, and a horizontal portion 4*i* extending in opposite horizontal directions from a lower end of the vertical portion 4*h* and lying above the group 3 of heating electric wires.

The group 4 of antenna wires has certain preferable dimensions that are given in the table below:

| | a | b | c | d | e |
|---|---|---|---|---|---|
| (mm) | 200 | 10 | 40 | 30 | 900 |

In the above table, the dimension a is the length of a segment of the horizontal portion 4*e* which extends beyond the vertical central line 6 to its distal end, the dimension b is the length of the vertical portion 4*f*, the dimension c is the length of the vertical portion 4*h*, the dimension d is the distance between the horizontal portion 4*i* and the uppermost heating electric wire of the group 3, and the dimension e is the length of the horizontal portion 4*i*.

The L-shaped section 4*a* of the antenna wires has a width of 3 mm, and the other sections of the antenna wires except the horizontal folded portion 4*g* have a width of 1 mm.

According to the present invention, the horizontal folded portion 4*g* comprises a plurality of thin wires, preferably in the range of two to three thin wires.

Figure 2:
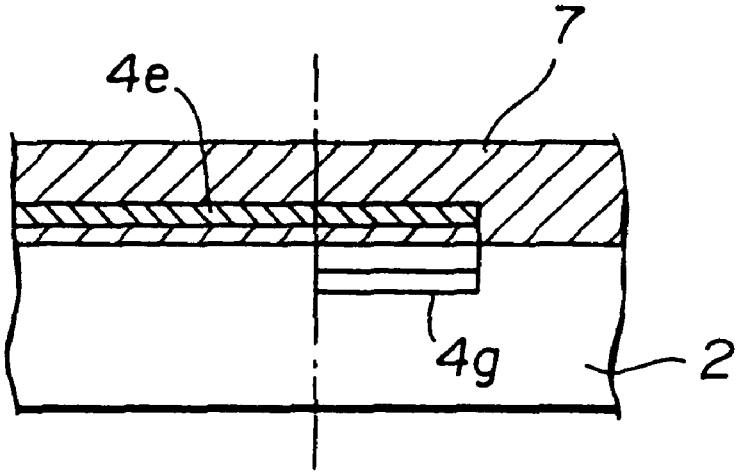
FIG. 2 is an enlarged fragmentary plan view of a molded region of a rear window glass antenna, which is composed of two thin antenna wires.

FIG. 2 shows a horizontal folded portion 4*g* which is composed of two thin wires lying parallel to each other.

Figure 3:
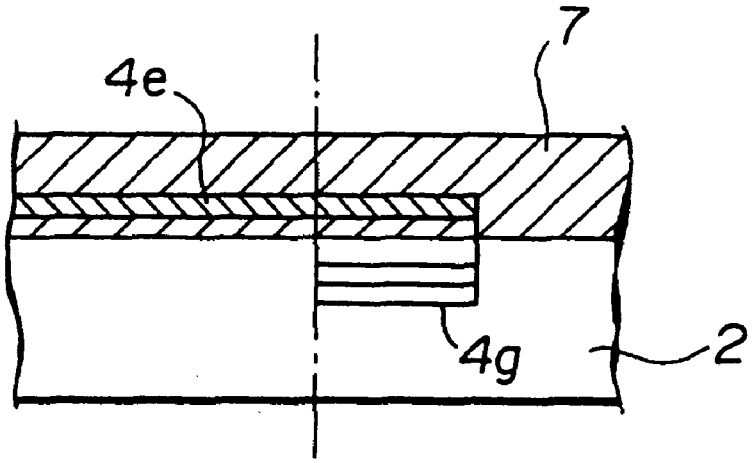
FIG. 3 is an enlarged fragmentary plan view of a folded region of a rear window glass antenna, which is composed of three thin antenna wires.

FIG. 3 shows a horizontal folded portion 4*g* which is composed of three thin wires lying parallel to each other.

In FIGS. 2 and 3, the horizontal portion 4*e* is concealed by a masked area 7 on the rear window glass panel 2.

The thin wires lying parallel to each other of the horizontal folded portion 4*g* are equivalent to a thicker wire for achieving an increased gain in a wider frequency band and also achieving a reduced impedance.

Each of the thin wires of the horizontal folded portion 4*g* has a width ranging from 0.4 to 1.2 mm, and the distance between the central axes of adjacent thin wires ranges from 1 to 3 mm. The width of the entire horizontal folded portion 4*g*, including the widths of the thin wires and the distance or distances therebetween, ranges from 3 to 10 mm.

The group 3 of heating electric wires, the buses 3*a*, 3*b*, the group 4 of antenna wires, and the feeder terminal 5 may be formed by printing an electrically conductive paste composed of fine particles of silver or glass of low melting point which are mixed with an organic solvent on the rear window glass panel 2 by screen process printing, or by sandwiching metallic wires between two glass layers.

When electromagnetic waves are received by the rear window glass antenna 1, the signal produced by the rear window glass antenna 1 is transmitted from the feeder terminal 5 to the receiver through a coaxial cable (not shoon).

Figure 4:
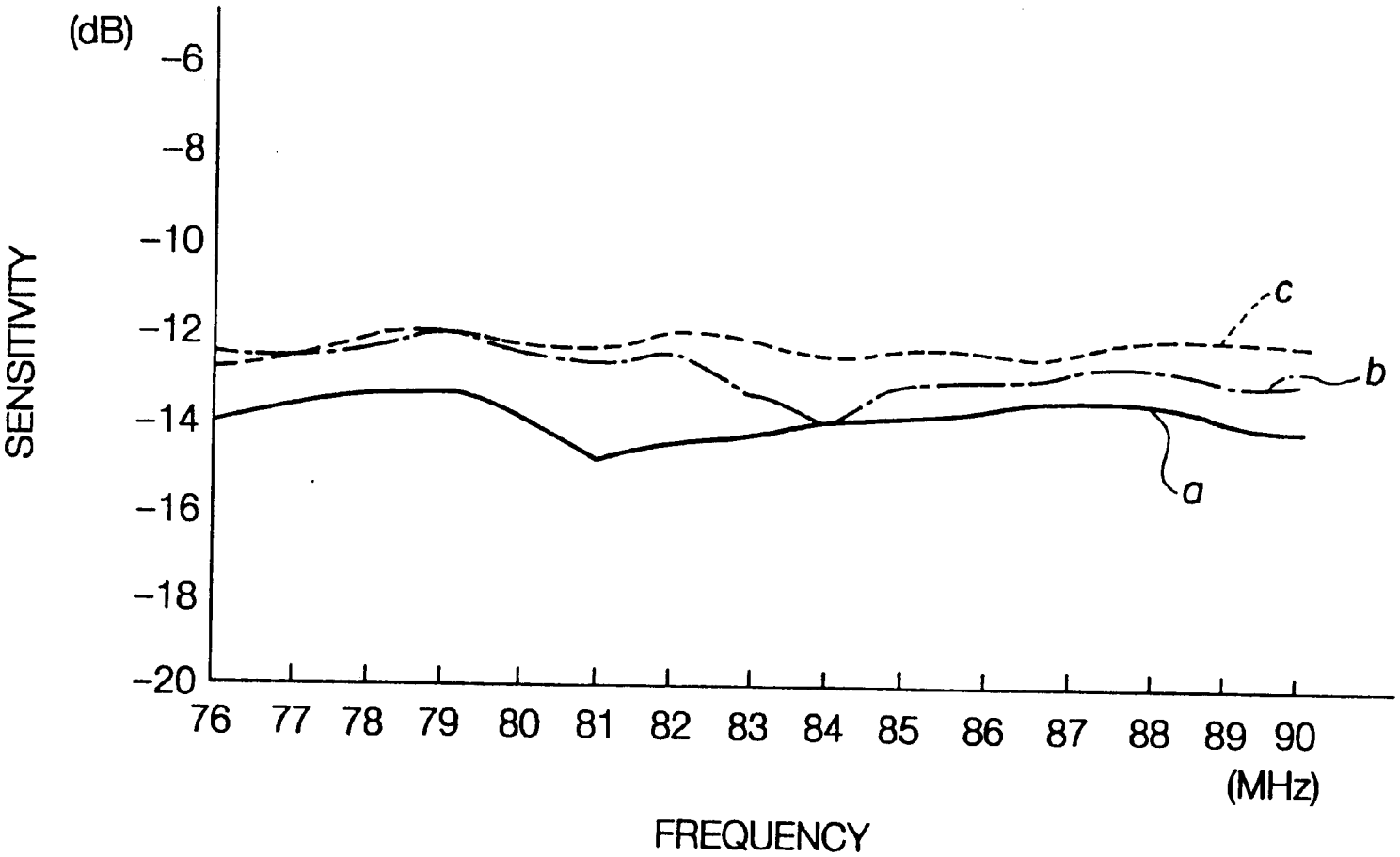
FIG. 4 is a graph showing sensitivity vs. frequency characteristics of different rear window glass antennas.

FIG. 4 shows sensitivity vs. frequency characteristics of different rear window glass antennas used to receive FM broadcasts in an FM broadcast frequency range from 76 MHz to 90 MHz. The horizontal axis of the graph illustrated in FIG. 4 represents the frequency, and the vertical axis thereof represents the sensitivity. Some numerical values of the sensitivity vs. frequency characteristics are shown in FIG. 5.

The solid-line curve as shown in FIG. 4 indicates sensitivities, plotted against the frequency, of a rear window glass antenna whose horizontal folded portion 4*g* comprises a single wire. The dot-and-dash-line curve b shown in FIG. 4 indicates sensitivities, plotted against the frequency, of a rear window glass antenna whose horizontal folded portion 4*g* comprises two thin parallel wires. The dotted-line curve c shown in FIG. 4 indicates sensitivities, plotted against the frequency, of a rear window glass antenna whose horizontal folded portion 4*g* comprises three thin parallel wires.

The average sensitivities of these rear window class antennas in terms of sensitivity differences (dipole ratios) with the sensitivity of a reference dipole antenna which is 0 dB are −13.9 dB, −12.8 dB, and −12.2 dB, respectively. It can thus be seen that the sensitivity of the rear window glass antenna can be increased at all frequencies by increasing the number of thin parallel wires. Therefore, the rear window glass antenna 1 according to the present invention has very good sensitivity vs. frequency characteristics.

Since the antenna portions which are exposed out of the masked area 7 are relatively thin, they are less visible than thicker wires and do not make the rear window glass panel 2 unsightly.

The rear window glass antenna 1 according to the present invention may be used singly on the rear window glass panel 2 for receiving radio or television broadcast waves. For better results, however, the rear window glass antenna 1 may be used in combination with glass antennas or the like on side window glass panels of the automobile for diversity reception.

Figure 6A:
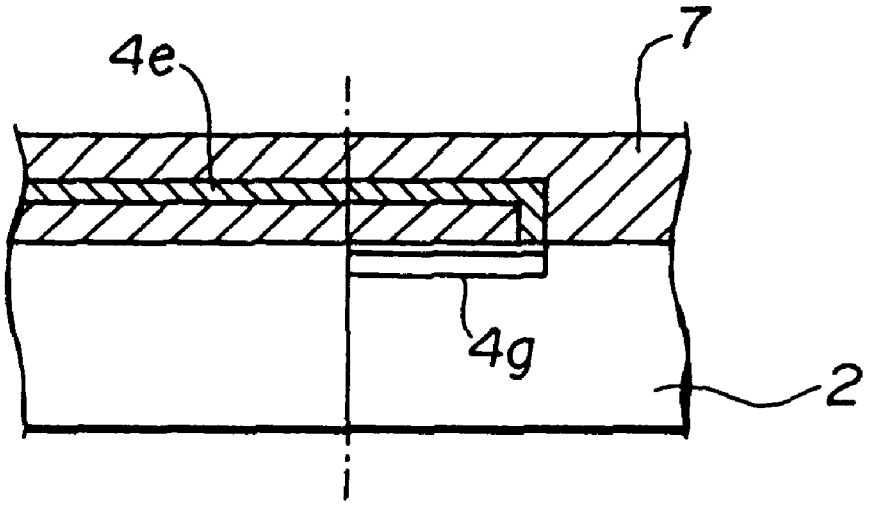
FIGS. 6(*a*) and 6(*b*) are enlarged. fragmentary plan views of modified rear window glass antennas.
Figure 6:
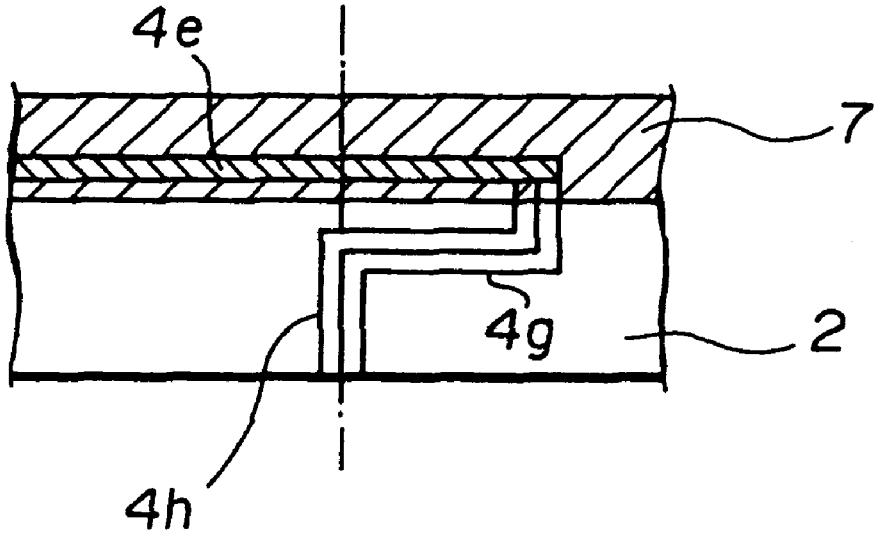

FIG. 6(*a*) shows a modified rear window glass antenna. In FIG. 6(*a*), the masked area 7 on the rear window class panel 2 is relatively large to reduce any problem on the appearance of the rear window glass panel 2, and the antenna portion concealed by the masked area 7 has a relatively large width in its entirety.

FIG. 6(*b*) illustrates another modified rear window glass antenna. In FIG. 6(*b*), both the horizontal folded portion 4*g* and also the vertical portion 4*h* are composed of a plurality of thin wires.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

What is claimed is:

1. A rear window glass antenna on a rear window glass panel of an automobile, the rear window glass panel including oppositely disposed upper and lower edges, oppositely disposed side edges, a central point, and a central vertical axis extending through the central point, comprising:

a plurality of heating wires disposed horizontally on the rear window glass panel;

a feeder terminal disposed on the rear window glass panel near at least one of the edges; and a plurality of antenna wires disposed on the rear window glass panel and connected to said feeder terminal and including:

a first section having a first end and a second end, the first section extending from the first end at the feeder terminal along at least one edge of the rear window glass panel, the first section extending beyond the central vertical axis and terminating at the second end;

a second section including a first portion folded from the second end of said first section away from said at least one edge of the rear window glass panel, and a second portion including a plurality of wires substantially parallel to each other, said second portion having third and fourth ends, said plurality of substantially parallel wires extending from said first portion at said third end of said second portion toward said feeder terminal to at least the central vertical axis of the rear window glass panel; and a third section extending as a main antenna section from said second section, said third section including a vertical portion connected to each of said plurality of wires of the second portion of said second section, the third section being electromagnetically coupled to the heating wires.

2. The rear window glass antenna of claim 1, wherein said second section includes a horizontally folded portion, said horizontally folded portion comprising a plurality of wires lying parallel to each other.

3. The rear window glass antenna of claim 1, wherein said second section comprises at least a plurality of wires.

* * * * *